US005894794A

United States Patent [19]

Imamaki et al.

[11] Patent Number: 5,894,794

[45] Date of Patent: Apr. 20, 1999

[54] STAMP UNIT HAVING STENCIL SHEET AND SKIRT MEMBER

[75] Inventors: Teruo Imamaki, Kasugai; Hiroshi Taira, Ichinomiya; Minoru Yamamoto, Yotsukaichi, all of Japan

[73] Assignee: Brother Kogyo Kabushiki Kaisha, Nagoya, Japan

[21] Appl. No.: 09/093,795

[22] Filed: Jun. 9, 1998

[30] Foreign Application Priority Data

Jun. 13, 1997 [JP] Japan ..... 9-156970

[51] Int. Cl.[6] ..... B41L 27/26

[52] U.S. Cl. ..... 101/125; 101/333

[58] Field of Search ..... 101/125, 327, 101/333, 127.1, 128.1

[56] References Cited

U.S. PATENT DOCUMENTS 3,886,863 6/1975 Carabott et al. ..... 101/125
4,172,419 10/1979 Munyon ..... 101/125
5,694,844 12/1997 Taira ..... 101/125

FOREIGN PATENT DOCUMENTS

U-5-41843 6/1993 Japan .
A-9-99618 4/1997 Japan .

*Primary Examiner*—Edgar Burr
*Assistant Examiner*—Leslie Grohusky
*Attorney, Agent, or Firm*—Oliff & Berridge PLC

[57] ABSTRACT

A stamp unit capable of preventing ink from leaking out of the stamp unit is disclosed. The stamp unit includes a skirt member attached to an ink impregnated body. The skirt member has a substrate formed with a through-hole at its center. A pair of first guides and a pair of second guides are provided on the substrate for guiding corresponding edge portions of a stencil sheet. The first guides extend in a lengthwise direction of the substrate, and the second guides extend in a widthwise direction of the substrate. A pair of third guides are provided on the substrate outside of the second guides. The third guides guide corner portions of the stencil sheet so as to position between the second guides and the third guides. The corner portions guided by the third guides have corners with sharp crease.

20 Claims, 8 Drawing Sheets

STAMP UNIT HAVING STENCIL SHEET AND SKIRT MEMBER

BACKGROUND OF THE INVENTION

1. Field of the Invention

The present invention relates to a stamp unit including a stamp body, an ink impregnated body fitted in the stamp body, and a stencil sheet formed with a stencil image and covering the ink impregnated body.

2. Description of Related Art

There has been proposed a stamp unit including a stamp body, an ink impregnated body fitted in the stamp body, and a thermal stencil sheet covering the ink impregnated body. The stencil sheet is formed with a stencil image. By pressing the ink impregnated body covered with the stencil sheet against a print medium to be printed on, an ink image corresponding to the stencil image is formed on the print medium.

Japanese Patent-Application Publication (Kokai) No. HEI-9-99618 has proposed a stamp unit 100 shown in FIGS. 1 to 4. The stamp unit 100 enables a stencil sheet to be easily attached to a stamp body, and also prevents ink leaks.

Specifically, as shown in FIG. 1, the stamp unit 100 includes a stamp body 101, an ink impregnated body 103, a stencil sheet S, and a skirt member 105. The stamp body 101 is formed in a rectangular parallelepiped shape, and has a grip portion 102. The ink impregnated body 103 is attached to a lower portion of the stamp body 101, and is impregnated with ink. The stencil sheet S is formed with a stencil image. The skirt member 105 is detachably fitted to the stamp body 103.

The skirt member 105 is formed in a rectangular frame shape with an inwardly extending lip portion 113 defining an opening portion 106 at its lower surface. The skirt member 105 has a pair of first inner wall surfaces 107 opposing each other and another pair of second inner wall surfaces 108 opposing each other. A first guide portion 109 is provided to each first inner wall surface 107 so as to protrude from the first inner wall surface 107 to an inner edge of the lip portion 113. A second guide portion 111 is provided to each inner wall surface 108 so as to protrude from the inner wall surface 108 to an inner edge of the lip portion 113. The first guide portion 109 and the second guide portion 111 have a top surface 110 and a top surface 112, respectively, to receive and guide the stencil sheet S and the stamp body 101 to which the ink impregnated body 103 is attached. As shown in FIG. 2, an escape portion 114 is formed to each of four internal corners of the skirt member 105 between the first guide portions 109 and the second guide portions 111.

Next, operations for mounting the stencil sheet S to the stamp body 101 will be described. First, the skirt member 105 is fitted to an outer periphery of the stamp body 101 from below while the stencil sheet S clings by viscosity of the ink to a lower surf ace of the ink impregnated body 103. Then, the slanting guide surfaces 110 of the first guide portions 109 guide corresponding lengthwise edge portions of the stencil sheet S into intimate contact with corresponding sides of the stamp body 101. Next, the slanting guide surfaces 112 of the second guide portions 111 guide widthwise edge portions of the stencil sheet S into intimate contact with corresponding sides of the stamp body 101. Corner portions 115 of the stencil sheet S shown in FIG. 3 enter the escape portions 114 as guided by the first and second guide portions 109, 111.

In this way, the stencil sheet S can be easily and reliably mounted to the ink impregnated body 103 without the stencil sheet S peeling away from the ink impregnated body 103.

However, ink may leak out from the corner portions 115 of the stencil sheet S when the stamp unit 100 is laid on its side. Specifically, although the lengthwise edge portions and the widthwise edge portions of the stencil sheet S are in the intimate contact with corresponding sides of the stamp body 101, the corner portions 115 are not, so that the corner portions 115 are open. Ink can leak out through the openings C in the corner portions 115.

Also, as shown in FIG. 4, an upper portion of the skirt member 105 is not in contact with the stamp body 101 so that a space 116 is formed between the upper part of the skirt member 105 and the stamp body 101. The space 116 exposes the escape portions 114, that is, the opening portions of the corner portions 115, so that ink from the corner portions 115 can leak out through the space 116.

Therefore, when the stamp unit 100 with a large amount of ink impregnated in the ink impregnated body 103 is laid on its side, the ink may flow from the ink impregnated body 103 through the corner portions 115 and the space 116 to the outside of the stamp unit 100.

This problem will not happen as long as the stamp unit 100 is handled while kept in an upright posture. However, it is inconvenient and difficult for a user to handle the stamp unit 100 in such a restricted manner.

SUMMARY OF THE INVENTION

It is an objective of the present invention to overcome the above and other problems and also to provide a stamp unit in which ink impregnated in an ink impregnated body will not leak out of the stamp unit even when the stamp unit is laid on its side.

In order to accomplish the above and other objectives, there is provided a stamp unit including a stamp body, an ink impregnated body, a stencil sheet, and a skirt. The stamp body includes an upper wall and side walls defining an inner space for containing ink. The side walls have inner surfaces and outer surfaces opposite the inner surfaces. The ink impregnated body has an upper surface and a lower surface. The ink impregnated body is attached to the stamp body such that the upper surface defines a bottom surface of the inner space of the stamp body. The ink impregnated body is impregnated with ink. The stencil sheet is formed with a stencil image and has a surface greater than the lower surface of the ink impregnated body. The stencil sheet has first edge portions extending in a first direction, second edge portions extending in a second direction perpendicular to the first direction, and corner portions. The stencil sheet is mounted on the lower surface of the ink impregnated body. The skirt member is detachably fitted to the stamp body. The skirt member includes a substrate, first guides, second guides, and third guides. The substrate is formed with a through-hole at its center into which the ink impregnated body is inserted such that the lower surface of the ink impregnated body positions below the substrate. The substrate has outer edges and inner edges. The inner edges have first inner edges extending in the first direction and second inner edges extending in the second direction. The first inner edges and the second inner edges define the through-hole. The first guides are disposed in upright posture on the substrate along the first inner edges. The second guides are disposed in upright posture on the substrate along the second inner edges. The third guides are disposed on the substrate. When the ink impregnated body is inserted into the through-hole of the skirt member so as to fit the skirt member to the stamp body, the first guides guide the first edge portions of the stencil sheet to bend upward along the outer surfaces of corresponding side walls of the stamp body, the second guide guides the second edge portions of the stencil sheet to bend upward along the outer surfaces of corresponding side walls of the stamp body, and the third guides guide corner portions of the stencil sheet toward either the first guides or the second guides.

Also, there is provided a stamp unit including an ink impregnated body, a stamp body, a stencil sheet, and a skirt member. The ink impregnated body is impregnated with ink and has a lower surface. The stamp body includes a supporting member and a frame. The supporting member supports the ink impregnated body such that the lower surface of the ink impregnated body is positioned below the supporting member. The frame surrounds the supporting member. The stencil sheet is formed with a stencil image and mounted on the lower surface of the impregnated body. The stencil sheet has a surface greater than the lower surface of the ink impregnated body, first edge portions extending in a first direction, second edge portions extending in a second direction perpendicular to the first direction, and corner portions. The skirt member is detachably fitted to the stamp body. The skirt member includes a substrate, first guides, second guides, third guides. The substrate is formed with a through-hole into which the ink impregnated body is inserted. The substrate has outer edges, first inner edges extending in the first direction, and second inner edges extending in the second direction. The first inner edges and the second inner edges define the through-hole. The first guides are disposed on the substrate along the first inner edges. The second guides are disposed on the substrate along the second inner edges. The second guides are disposed between the first guides without contacting the first guides. The third guides are disposed on the substrate while keeping distances from the second guides. Each of the third guides has a middle portion and curved end portions. The middle portion extends in parallel with the second guide. The curved end portions are positioned between the first guides and the second guides. When the ink impregnated body is inserted into the through-hole of the skirt member for fitting the skirt member to the body, the first guides guide the first edge portions of the stencil sheet to bend upward, the second guides guide the second edge portions of the stencil sheet to bend upward, and the third guides guide corresponding corner portions of the stencil sheet to bend toward the second guides.

Further, there is provided a stamp unit including ink holding means for holding ink, supporting means for supporting the ink holding means such that a lower surface of the ink holding means is positioned below the supporting means, stencil sheet means formed with a stencil image, substrate means, first guiding means, second guiding means, and third guiding means. The stencil sheet means for transferring ink held in the ink holding means in reiteration to the stencil image and is mounted on the lower surface of the ink holding means. The stencil sheet means has a surface greater than the lower surface of the ink holding means. The stencil sheet means has first edge portions extending in a first direction, second edge portions extending in a second direction perpendicular to the first direction, and corner portions. The substrate means is for providing a through-hole into which the ink holding means is inserted. The substrate means has outer edges, first inner edges extending in the first direction, and second inner edges extending in the second direction. The first inner edges and the second inner edges define the through-hole. The first guiding means is for guiding the first edge portions of the stencil sheet means, and is disposed on the substrate means along the first inner edges. The first guiding means defines an area. The second guiding means is for guiding the second edge portions of the stencil sheet means. The second guiding means is disposed on the substrate means along the second inner edges and within the area defined by the first guiding means without contacting the first guiding means. The first guiding means and the second guiding means are detachably fitted to the supporting means. The third guiding means is for guiding the corner portions of the stencil sheet means. The third guiding means is being on the substrate means while keeping distances from the second guiding means. The third guiding means includes a middle portion extending in parallel with the second guiding means and curved end portions positioned between the first guiding means and the second guiding means. Wen the ink holding means is inserted into the through-hole of the substrate means, the first guiding means guide the first edge portions of the stencil sheet means to bend upward, the second guiding means guide the second edge portions of the stencil sheet means to bend upward, and the third guiding means guide the corner portions of the stencil sheet means to bend toward the second guiding means.

BRIEF DESCRIPTION OF THE DRAWINGS

The particular features and advantages of the invention as well as other objects will become more apparent from the following description taken in connection with the accompanying drawings, in which:

FIG. 9(*b*) is a perspective view partially in phantom showing an operation for mounting the stencil sheet to the stamp body;

FIG. 9(*c*) is a perspective view partially in phantom showing the stamp body with the stencil sheet mounted thereon;

DETAILED DESCRIPTION OF THE PREFERRED EMBODIMENTS

A stamp unit according to a preferred embodiment of the present invention will be described while referring to the accompanying drawings.

Figure 5:
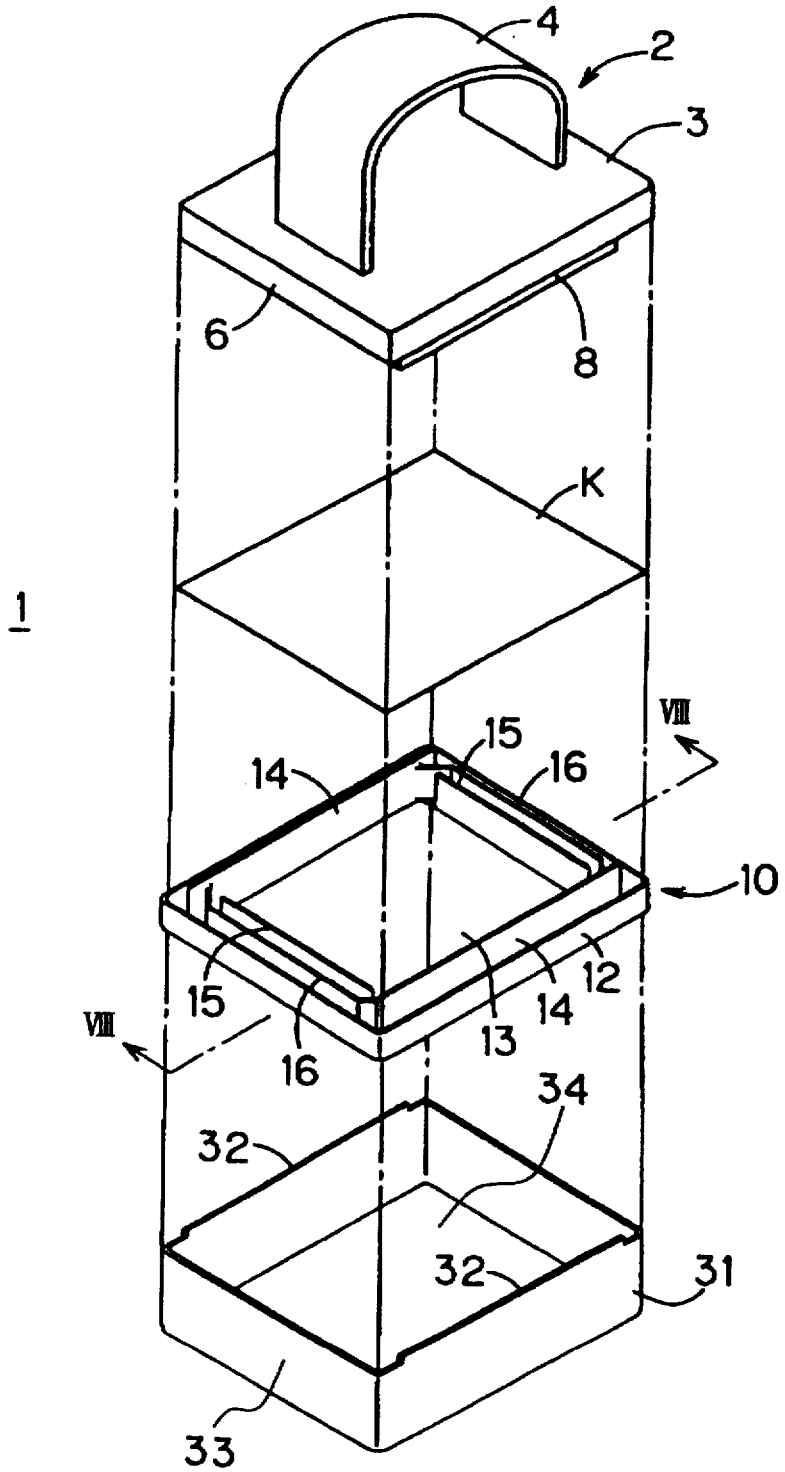
FIG. 5 is an exploded perspective view showing a stamp unit according to an embodiment of the present invention, the stamp unit including a stamp body, a stencil sheet, a skirt member, and a cover.
Figure 6:
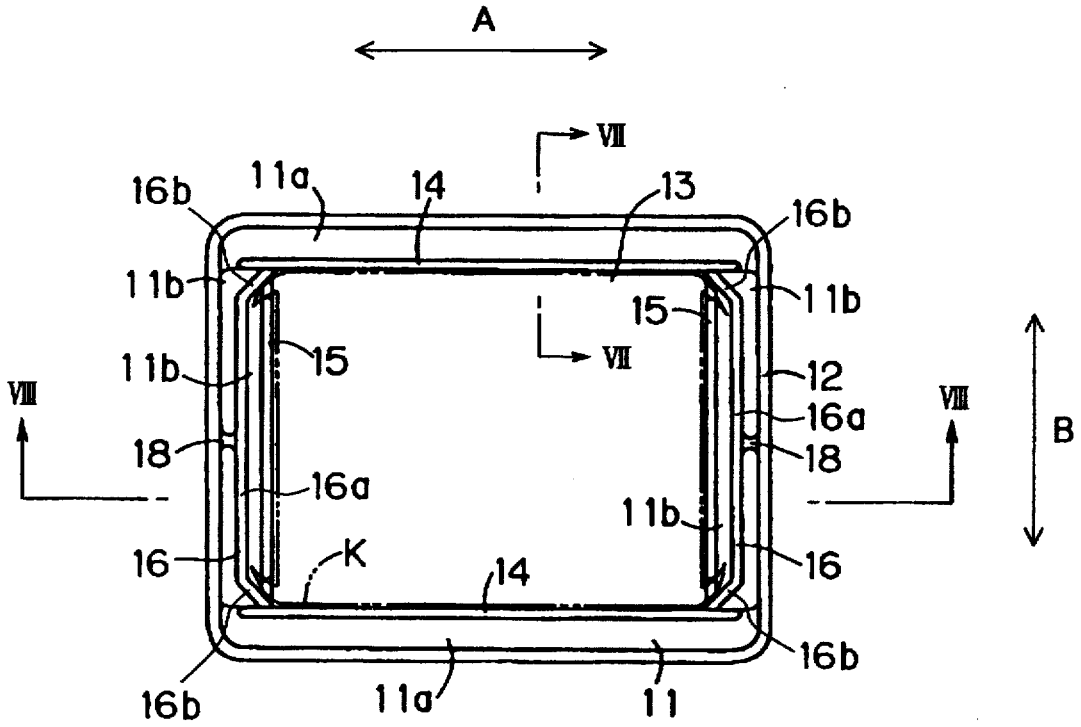
FIG. 6 is a plan view showing the skirt member of the stamp unit of FIG. 5.

As shown in FIG. 5, a stamp unit 1 includes a stamp body 2, an ink impregnated body 8, a stencil sheet K, a skirt member 10, and a cover 31. As shown in FIG. 6, the stamp unit 1 has a rectangular shape when viewed from the above. The stamp unit 1 has a length in a direction indicated by an arrow A and a width in a direction indicated by an arrow B. In this embodiment, the length is longer than the width.

Figure 8:
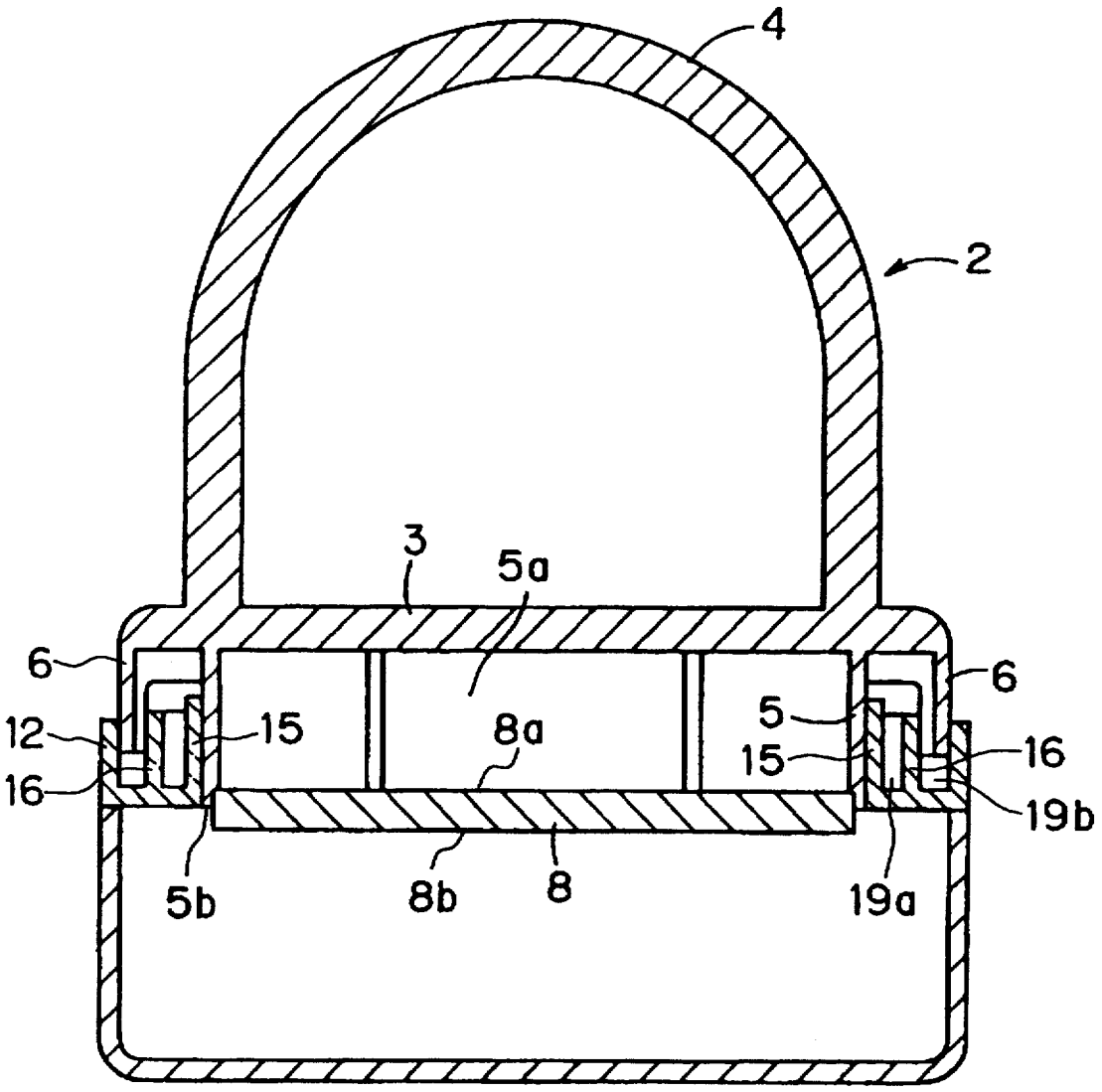
FIG. 8 is a cross-sectional view taken along a line VIII—VIII in FIGS. 5 and 6.

As shown in FIGS. 5 and 8, the stamp body 2 includes a substrate 3, a support portion 5, side walls 6, and a grip portion 4. The substrate 3 is formed in a rectangular plate shape. The support portion 5 protrudes downward from an undersurface of the substrate 3 and has a frame shape defining an inner space 5*a*. The side walls 6 protrude downward from edges of the substrate 3 so as to surround the support portion 5. The side walls 6 are separated from the support portion 5 by a predetermined distance. The grip portion 4 is provided on an upper surface of the substrate 3.

The ink impregnated body 8 is formed in a rectangular plate shape from a material, such as a foamed synthetic resin or non-woven fabric, capable of holding ink. The ink impregnated body 8 has an upper surface 8*a* and an under surface 8*b*. The ink impregnated body 8 is fixedly attached to a lower portion of the support portion 5 such that the under surface 8*b* is disposed below an under edge 5*b* of the support portion 5. The upper surface 8*a* of the ink impregnated body 8 is exposed to the inner space 5*a* in which ink is contained. The ink in the inner space 5*a* is impregnated into the ink impregnated body 8 and held therein.

The stencil sheet K is attached to the under surface 8*b* of the ink impregnated body 8. The stencil sheet K is a thermal stencil sheet with a stencil image printed therein in advance by a thermal printer (not shown). The stencil sheet K is cut to a width and length greater than at least the width and length of the support portion 5.

The skirt member 10 is detachably attached to a lower portion of the stamp body 2. As show in FIGS. 5 to 8, the skirt member 10 includes a substrate 11, an outer frame 12, a pair of first guides 14, a pair of second guides 15, a pair of third guides 16, and a pair of ribs 18. The substrate 11 has an opposing pair of first substrate portions 11*a* extending in the lengthwise direction and another opposing pair of second substrate portions 11*b* extending in the widthwise direction. The first and second substrate portions 11*a*, 11*b* define a rectangular through-hole 13. An upper surface of the first portion 11*a* is disposed higher than an upper surface of the second portion 11*b*. The outer frame 12 is attached to outer side edges of the substrate 11 so as to surround the substrate 11. Each first guide 14 is provided in an upright posture on and along a corresponding inner edge of the first substrate portion 11*a*. Each second guide 15 is disposed between the pair of the first guides 14 without contacting the second guide 14. The second guides 15 are disposed on the upper surface of the second substrate portion 11*b* so as to follow the inner edge of the second substrate portion 11*b*. The third guides 16 are disposed in an upright posture on the second substrate portion 11*b*. The third guides 16 are disposed between the outer frame 12 and the second guides 15 without contacting either. Each of the third guides 16 has a middle portion 16*a* and end portions 16*b* which are bent so as to be positioned between the first guides 14 and the second guides 15. The middle portion 16*a* is extending in parallel with the second guide 14.

The first guides 14 have a first height above the substrate 11. The second guides 15 have a second height above the substrate 11 lower than the first height. The third guides 16 have a third height above the substrate 11 lower than the second height. When the skirt member 10 is attached to the stamp body 2, inner surfaces of the first and second guides 14, 15 come into intimate contact with corresponding outer surfaces of the support portion 5, and also inner surfaces of the outer frame 12 come into intimate contact with outer surfaces of the side walls 6.

Figure 10:
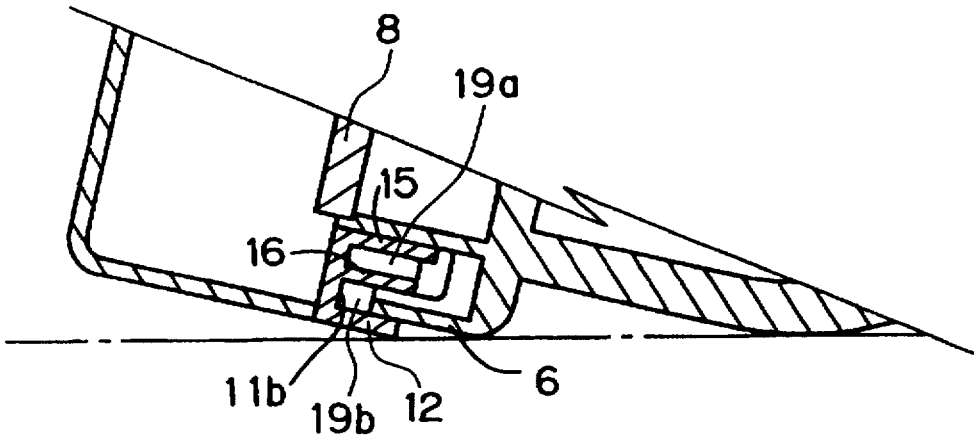
FIG. 10 is a partial cross-sectional view showing the stamp unit laid on its side.
Figure 11:
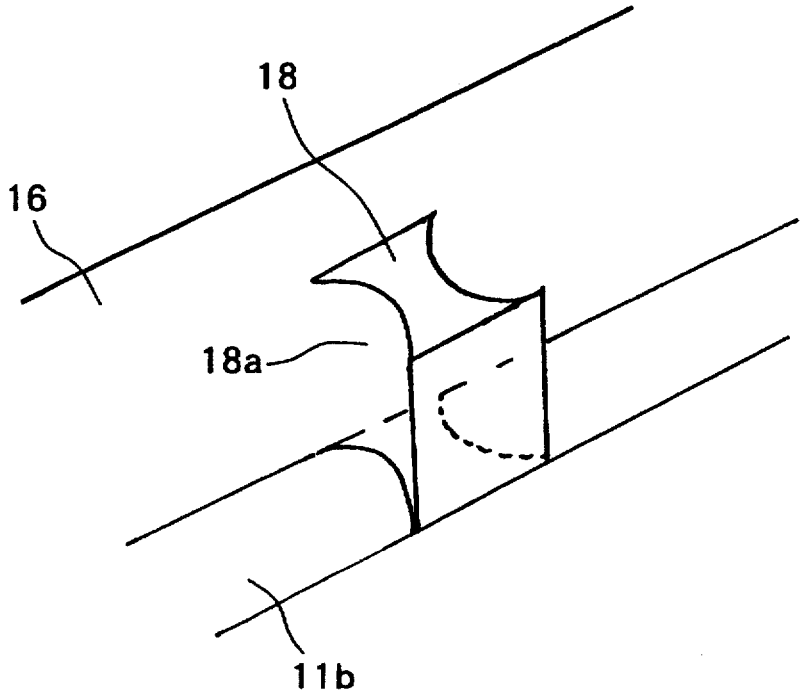
FIG. 11 is a perspective view showing a rib disposed between a third guide and an outer frame of the skirt member.

Each rib 18 is provided on the second substrate portion 11*b* at a position between the outer frame 12 and the third guide 16 and defines spaces 19*b* as shown in FIG. 10. As shown in FIG. 11, the rib 18 has inwardly curved sides 18*a* that span between the outer frame 12 and the third guide 16 and that contact the outer frame 12 and the third guide 16 at obtuse angles. An upper edge of the rib 18 is level with the upper surface of the first substrate portion 11*a*.

Figure 7:
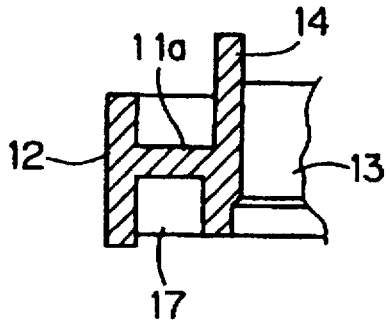
FIG. 7 is a cross-sectional view taken along a line VII—VII in FIG. 6.

As shown in FIG. 7, the outer frame 12, the first substrate portion 11*a*, and the first guide 14 define a receiving portion 17 below the substrate 11 for receiving the cover 31.

As shown in FIG. 5, the cover 31 is formed in a box shape with an open top surface. The cover 31 is detachably attached to the skirt member 10 when the stamp unit 1 is unused. The cover 31 includes side walls 33 and a bottom wall 34. An opposing pair of side walls 33 are formed with protruding portions 32. When the cover 31 is attached to the skirt member 10, the protruding portions 32 are received into corresponding receiving portions 17.

Figure 9:
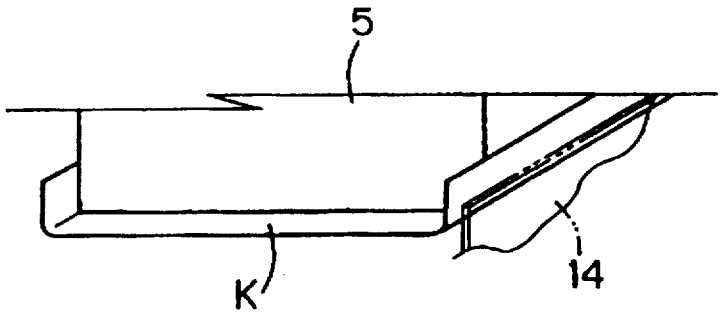
FIG. 9(*a*) is a perspective view partially in phantom showing an operation for mounting the stencil sheet to the stamp body.
Figure 9:
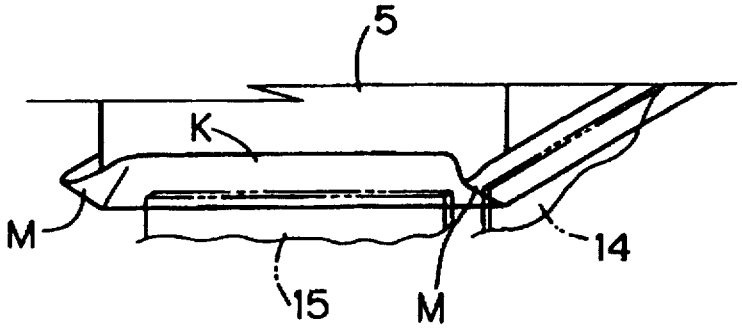
Figure 9:
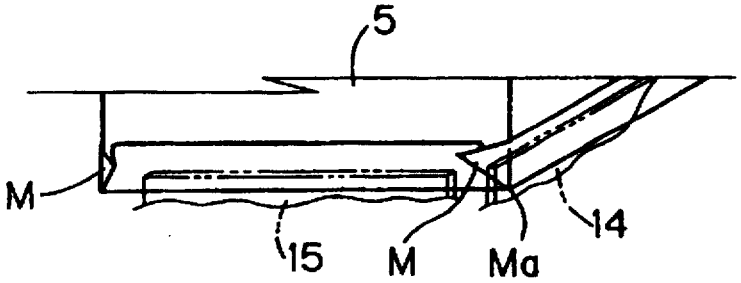

Next, operations for mounting the stencil sheet K to the stamp body 2 will be described while referring to FIGS. 9(*a*) to 9(*c*). First, the stencil sheet K is attached to the ink impregnated body 8, which is attached to the stamp body 2. Then, the stamp body 2 is inserted into the through-hole 13 so that the first guides 14 with the first height come in contact with the stencil sheet K. As shown in FIG. 9(*a*), when the ink impregnated body 8 is further inserted into the through-hole 13, lengthwise edge portions of the stencil sheet K are guided by the first guides 14 to bent upward along the outer surfaces of the support portion 5, thereby bringing the lengthwise edge portions of the stencil sheet K into intimate contact with the outer surfaces of the support portion 5. Next, as shown in FIG. 9(*b*), widthwise edge portions of the stencil sheet K are guided by the second guides 15 to bent upward. Also, corner portions M of the stencil sheet K are formed. At this time, because the second guides 15 are provided between the pair of the first guides 14, the corner portions M protrude in a direction parallel with the first guides 14, that is, in the lengthwise direction.

Then, as shown in FIG. 9(*c*), widthwise edge portions of the stencil sheet K are brought into intimate contact with the outer surfaces of the support portion 5. At the same time, the corner portions M are guided by the third guides 16 so as to be positioned between the second and third guides 15, 16. It should be noted that the orientation of the corner portion M to be guided is determined by the third guide 16, more specifically, by the position of the third guide 16 and also by the curved end portions 16*b* of the third guide 16. As described above, in the present embodiment, each end portion 16*b* of the third guides 16 is positioned between the first and second guides 14, 15, and each of the third guides 16 is positioned between the pair of the first guides 14 and outside of the corresponding second guide 15. With this configuration, the corner portions M can be guided so as to be positioned between the second guides 15 and the third guides 16. Then, as a result, corners Ma of the stencil sheet K are formed with a sharp crease. Because, as described above, the edge portions of the stencil sheet K are guided by the first guides 14, the second guides 15, and the third guides 16 in this order rather than at the same time, the clean-fold corner portions M can be formed without being crumpled.

When the lower portion of the stamp body 2 is completely inserted into the through-hole 13, the ink impregnated body 8 covered with the stencil sheet K protrudes below the skirt member 10. At this time, the outer frame 12 of the skirt member 10 is in contact with the outer surfaces of the side walls 6.

In this way, the skirt member 10 is attached to the stamp body 2. It should be noted that the protruding portion of the ink impregnated body 8 covered with the stencil sheet K serves as a printing surface.

Figure 1:
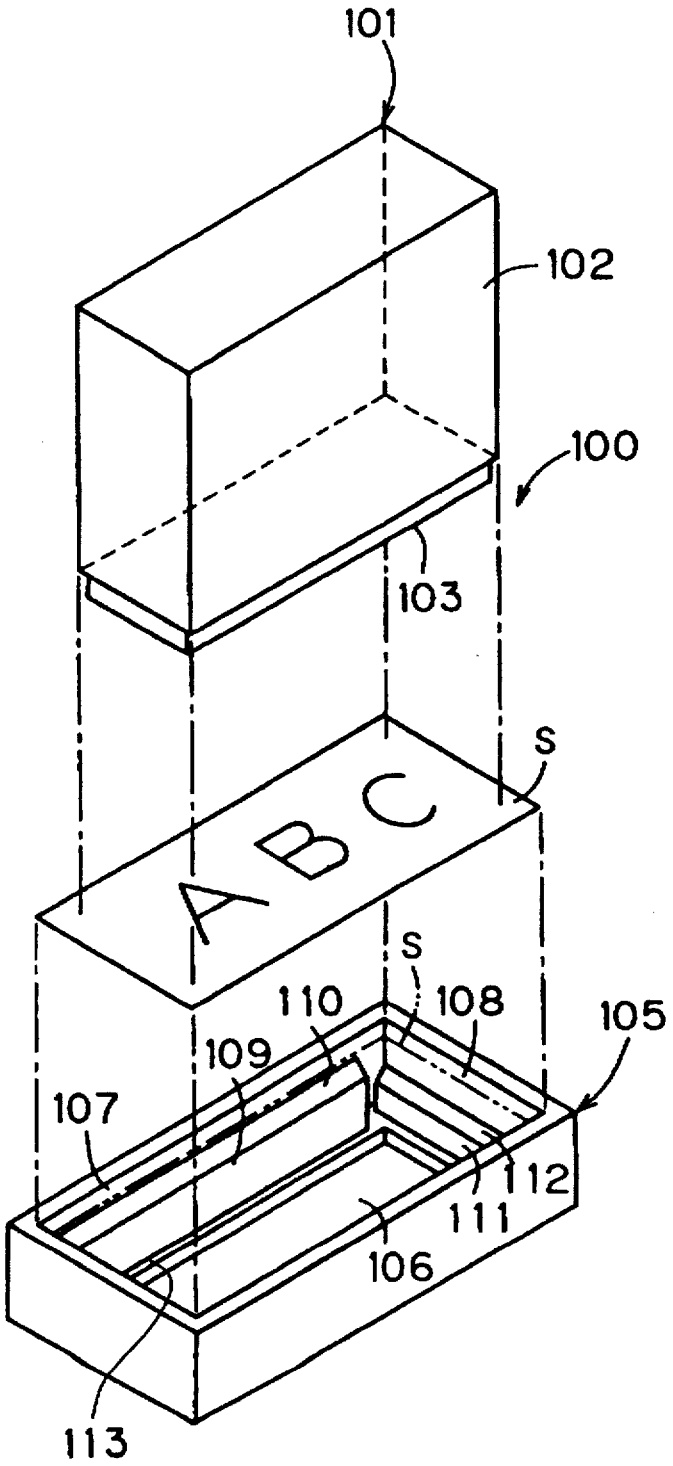
FIG. 1 PRIOR ART
FIG. 1 is a perspective view partially in phantom showing assembly of a stamp body, a stencil sheet, and a skirt member of a conventional stamp.
Figure 2:
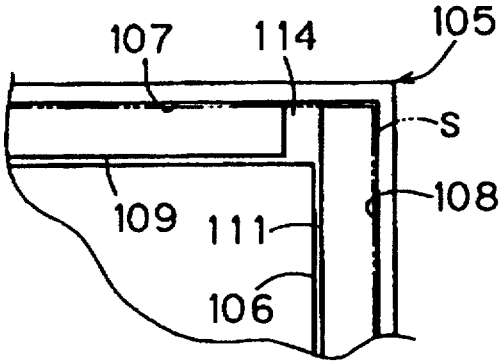
FIG. 2 PRIOR ART
FIG. 2 is an enlarged plan view showing corner portions of the skirt member of FIG. 1.
Figure 3:
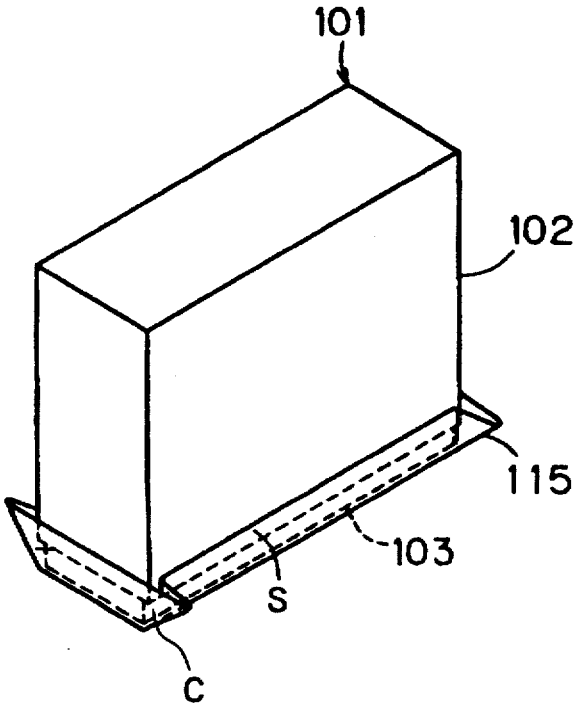
FIG. 3 PRIOR ART
FIG. 3 is a perspective view showing the stamp body and the stencil sheet of FIG. 1.
Figure 4:
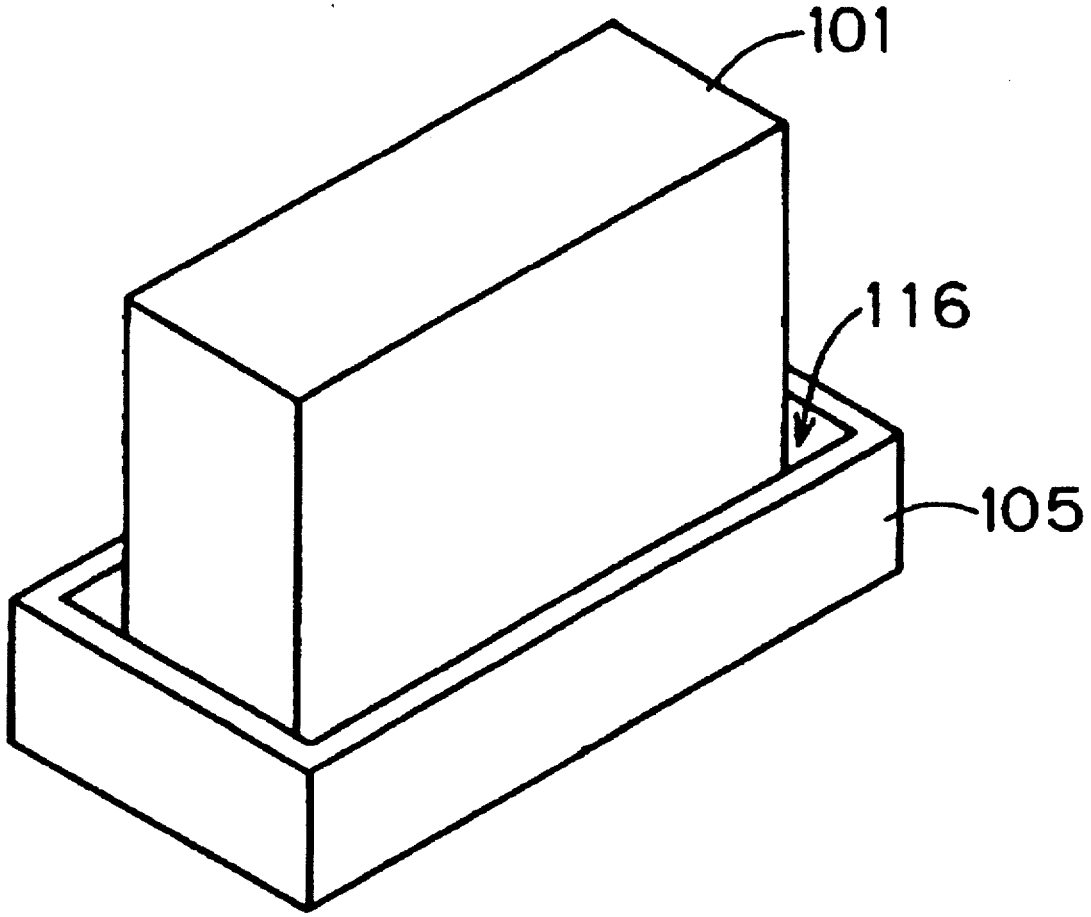
FIG. 4 PRIOR ART
FIG. 4 is a perspective view showing the assembled conventional stamp unit.

According to the stamp unit 1 described above, the stencil sheet K can be easily and reliably mounted to the ink impregnated body 8. Also, because the stencil sheet K has the corners Ma with sharp creases, the corner portions M are closed, which contrasts with the opened corner portions 115 shown in FIG. 3. Therefore, even if the stamp unit 1 is laid on its side as shown in FIG. 10, ink is prevented from leaking out of the stamp unit 1 through the corner portions M.

A small amount of ink may leak out through the corner portions M when the stamp unit 1 is laid on its side as shown in FIG. 10. However, because the corner portion M is positioned between the second and third guides 15, 16, ink leaked from the corner portion M is guided to a space 19*a* formed between the second and third guides 15, 16. Capillary action will prevent the ink from leaving the space 19*a*.

Also, because the outer frame 12 and the wall 6 are in intimate contact with each other, even if the ink leaks out of the space 19*a*, the ink would be prevented from leaking out of the stamp unit.

Further, because the rib 18 contacts the third guide and the outer frame 12 at obtuse angles, ink will not flow along a curved corner between the third guide 16 and the curved surface 18*a*, and a curved corner between the outer frame 12 and the curved surface 18*a*. More specifically, if the rib 18 contacted with the outer frame 12 and the third guide 16 at right angles, capillary action would produce an ink flow route along a corner defined between the third guide 16 and the curved surface 18*a* and a corner defined between the outer frame 12 and the curved surface 18*a*, when ink leaks out of the space 19*a* between the second and third guides 15, 16. In this way, ink would leak out of the stamp unit 1 by flowing along the ink flow route. However, according to the present embodiment, because the rib 18 contacts with the outer frame 12 and the third guide 16 at obtuse angles, no ink flow route is developed along the curved corners between the third guide 16 and the curved surface 18*a* and between the outer frame 12 and the curved surface 18*a*. Therefore, ink is securely prevented from leaking out of the stamp unit 1.

Also, according to the stamp unit 1 described above, the upper surface of the first portion 11*a* is disposed higher than the upper surface of the second portion 11*b*. Therefore, when ink is leaked onto the upper surface of the first portion 11*a* when the stamp unit 1 is in its upright posture, the ink flows onto the upper surface of the second portion 11*b* where the ink is held.

While the invention has been described in detail with reference to specific embodiments thereof, it would be apparent to those skilled in the art that various changes and modifications may be made therein without departing from the spirit of the invention, the scope of which is defined by the attached claims.

In the above description, the expressions "upper", "lower", "above", "below", "downward", "inner", and "outer" are used throughout the description to define the various parts when the stamp unit is disposed in an orientation in which it is intended to be used.

What is claimed is:

1. A stamp unit comprising:

a stamp body including an upper wall and side walls defining an inner space for containing ink, the side walls having inner surfaces and outer surfaces opposite the inner surfaces;

an ink impregnated body having an upper surface and a lower surface, the ink impregnated body being attached to the stamp body such that the upper surface defines a bottom surface of the inner space of the stamp body, the ink impregnated body being impregnated with ink;

a stencil sheet formed with a stencil image and having a surface greater than the lower surface of the ink impregnated body, the stencil sheet having first edge portions extending in a first direction, second edge portions extending in a second direction perpendicular to the first direction, and corner portions, the stencil sheet being mounted on the lower surface of the ink impregnated body; and a skirt member detachably fitted to the stamp body, the skirt member including:

a substrate formed with a through-hole at its center into which the ink impregnated body is inserted such that the lower surface of the ink impregnated body positions below the substrate, the substrate having outer edges and inner edges, the inner edges having first inner edges extending in the first direction and second inner edges extending in the second direction, the first inner edges and the second inner edges defining the through-hole;

first guides disposed in upright posture on the substrate along the first inner edges;

second guides disposed in upright posture on the substrate along the second inner edges; and third guides disposed on the substrate;

wherein when the ink impregnated body is inserted into the through-hole of the skirt member so as to fit the skirt member to the stamp body, the first guides guide the first edge portions of the stencil sheet to bend upward along the outer surfaces of corresponding side walls of the stamp body, the second guides guide the second edge portions of the stencil sheet to bend upward along the outer surfaces of corresponding side walls of the stamp body, and the third guides guide corner portions of the stencil sheet toward either the first guides or the second guides.

2. The stamp unit according to claim 1, wherein the first edge portions of the stencil sheet are in intimate contact with the outer surfaces of the side walls and the first guides, and the second edge portions of the stencil sheet are in intimate contact with the outer surfaces of the side walls and the second guides.

3. The stamp unit according to claim 1, wherein the second guides are disposed between the first guides without contacting the first guides; each of the third guides has a middle portion and curved end portions, the middle portion extending in parallel with the second guide, the end portions being positioned between the first guides and the second guides.

4. The stamp unit according to claim 3, wherein the substrate of the skirt member includes first substrates and second substrates positioned lower than the first substrates, wherein the first guides are disposed on the first substrates, and the second guides and the third guides are positioned on the second substrates.

5. The stamp unit according to claim 1, wherein the first guides have a first height, the second guides have a second height lower than the first height, and the third guides have a third height lower than the second height.

6. The stamp unit according to claim 1, wherein the stamp body further includes outer side walls surrounding the side walls without contacting the side walls; and the skirt member includes outer walls disposed in upright posture on the substrate along the outer edges, the outer walls being in intimate contact with the outer side walls of the stamp body, wherein the third guides are positioned between the second guides and the outer walls.

7. The stamp unit according to claim 6, wherein the skirt member further includes ribs each provided on the substrate between the third guide and the outer wall each of the ribs having curved sides that span between the third guide and the outer wall and contacting the third guide and the outer wall at obtuse angles.

8. The stamp unit according to claim 1, wherein the first inner edge of the substrate is longer than the second inner edge.

9. The stamp unit according to claim 1, further comprising a cover formed in a box shape with an upper opening portion, the cover detachably engaging the skirt member.

10. The stamp unit according to claim 1, wherein the corner portions of the stencil sheet guided by the third guides are folded with a sharp crease.

11. The stamp unit according to claim 1, wherein the stamp body further includes a grip portion attached to the upper wall.

12. A stamp unit comprising:

an ink impregnated body impregnated with ink and having a lower surface;

a stamp body including a supporting member and a frame, the supporting member supporting the ink impregnated body such that the lower surface of the ink impregnated body is positioned below the supporting member, the frame surrounding the supporting member;

a stencil sheet formed with a stencil image, the stencil sheet being mounted on the lower surface of the ink impregnated body, the stencil sheet having a surface greater than the lower surface of the ink impregnated body, the stencil sheet having first edge portions extending in a first direction, second edge portions extending in a second direction perpendicular to the first direction, and corner portions; and a skirt member detachably fitted to the stamp body, the skirt member including:

a substrate formed with a through-hole into which the ink impregnated body is inserted, the substrate having outer edges, first inner edges extending in the first direction, and second inner edges extending in the second direction, the first inner edges and the second inner edges defining the through-hole;

first guides disposed on the substrate along the first inner edges;

second guides disposed on the substrate along the second inner edges, the second guides being disposed between the first guides without contacting the first guides;

third guides disposed on the substrate while keeping distances from the second guides, each of the third guides having a middle portion and curved end portions, the middle portion extending in parallel with the second guide, the curved end portions being positioned between the first guides and the second guides, wherein when the ink impregnated body is inserted into the through-hole of the skirt member for fitting the skirt member to the stamp body, the first guides guide the first edge portions of the stencil sheet to bend upward, the second guides guide the second edge portions of the stencil sheet to bend upward, and the third guides guide corresponding corner portions of the stencil sheet to bend toward the second guides.

13. The stamp unit according to claim 12, wherein the first guide has a first height above the substrate; the second guide has a second height lower than the first height above the substrate; and the third guide has a third height lower than the second height above the substrate.

14. The stamp unit according to claim 12, wherein the substrate includes first substrates and second substrates positioned lower than the first substrates, wherein the first guides are disposed on the first substrates, and the second guides and the third guides are disposed on the second substrates.

15. The stamp unit according to claim 12, wherein the first edge portions of the stencil sheet are in intimate contact with the supporting member and the first guides; the second edge portions of the stencil sheet are in intimate contact with the supporting member and the second guides; and the corner portions of the stencil sheet are positioned between the second guides and the third guides.

16. The stamp unit according to claim 12, wherein the skirt member further includes side walls disposed on the substrate along the outer edges, the side walls being in intimate contact with the frame of the stamp body.

17. The stamp unit according to claim 16, wherein the skirt member further includes ribs each provided on the substrate between the third guide and the side wall, each of the ribs having curved sides that span between the third guide and the side wall, each of the ribs contacting the third guide and the side wall at obtuse angles.

18. The stamp unit according to claim 12, wherein the supporting member is formed with an inner space containing ink to supply to the ink impregnated body.

19. The stamp unit according to claim 12, wherein the stamp body further includes a grip portion attached to the frame.

20. A stamp unit comprising:

ink holding means for holding ink, the ink holding means having a lower surface;

supporting means for supporting the ink holding means such that the lower surface of the ink holding means is positioned below the supporting means;

stencil sheet means formed with a stencil image for transferring ink held in the ink holding means in relation to the stencil image, the stencil sheet means being mounted on the lower surface of the ink holding means, the stencil sheet means having a surface greater than the lower surface of the ink holding means, the stencil sheet means having first edge portions extending in a first direction, second edge portions extending in a second direction perpendicular to the first direction, and corner portions;

substrate means for providing a through-hole into which the ink holding means is inserted, the substrate means having outer edges, first inner edges extending in the first direction, and second inner edges extending in the second direction, the first inner edges and the second inner edges defining the through-hole;

first guiding means for guiding the first edge portions of the stencil sheet means, the first guiding means being disposed on the substrate means along the first inner edges, the first guiding means defining an area, the first guiding means being detachably fitted to the supporting means;

second guiding means for guiding the second edge portions of the stencil sheet means, the second guiding means being disposed on the substrate means along the second inner edges and within the area defined by the first guiding means without contacting the first guiding means, the second guiding means being detachably fitted to the supporting means; and third guiding means for guiding the corner portions of the stencil sheet means, the third guiding means being disposed on the substrate means while keeping distances from the second guiding means, each of the third guiding means including a middle portion and curved end portions, the middle portion extending in parallel with the second guiding means, the curved end portions being positioned between the first guiding means and the second guiding means;

wherein when the ink holding means is inserted into the through-hole of the substrate means, the first guiding means guide the first edge portions of the stencil sheet means to bend upward, the second guiding means guide the second edge portions of the stencil sheet means to bend upward, and the third guiding means guide the corner portions of the stencil sheet means to bend toward the second guiding means.

* * * * *